US006964498B2

(12) United States Patent
Wu

(10) Patent No.: US 6,964,498 B2
(45) Date of Patent: Nov. 15, 2005

(54) MULTI-VARIATION DECORATIVE LAMP

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 147 days.

(21) Appl. No.: 10/462,802

(22) Filed: Jun. 17, 2003

(65) Prior Publication Data

US 2004/0257806 A1 Dec. 23, 2004

(51) Int. Cl.[7] ..... F21S 13/14

(52) U.S. Cl. ..... 362/242; 362/231; 362/233; 362/806

(58) Field of Search ..... 362/231, 233, 362/235, 237–238, 240, 242, 245, 806, 225–227

(56) References Cited

U.S. PATENT DOCUMENTS 4,173,038 A * 10/1979 Kiefer ..... 362/35
5,749,646 A * 5/1998 Brittell ..... 362/231
6,166,496 A * 12/2000 Lys et al. ..... 315/316
6,179,449 B1 * 1/2001 Chen ..... 362/293
6,241,362 B1 * 6/2001 Morrison ..... 362/231
6,464,368 B1 * 10/2002 Chen ..... 362/96

* cited by examiner

*Primary Examiner*—Ali Alavi
(74) *Attorney, Agent, or Firm*—McGlew and Tuttle, P.C.

(57) ABSTRACT

A multi-variation decorative lamp, comprising: a light emitting device including a plurality of light emitting units for emitting lights of different wave lengths in combination; a functions control device for generating and emitting a plurality of electric waves, it is connected to and control said light emitting units; a power supply device, to be connected to said functions control device for supplying electric power; decorative objects, formed by one or a plurality of light penetrating materials with identical or different reflection or refraction coefficients or light-absorbing efficiency; it is located near said light-emitting unit; and, when said functions control device generates the electric wave according to pre-designed functions, the light emitting units then emit light of multi-variations, such that each of the decorative objects generates functions of multi-variations.

57 Claims, 9 Drawing Sheets

MULTI-VARIATION DECORATIVE LAMP

BACKGROUND OF THE INVENTION

1. Field of the Invention

The present invention relates to a multi-variation decorative lamp, especially to a decorative lamp which combines a functions control device for generating and emitting multi types of electric waves, such that lights of different wavelengths would be emitted by a plurality of light emitting elements, and then by the materials with identical or different light-absorbing efficiencies to be attached onto or put inside the light-emitting units enveloping said light emitting elements, a function of multi-variation decoration is then obtained.

2. Description of the Prior Art

As shown in FIGS. 1, 2, and 3, a conventional decorative lamp assembly disclosed in U.S. Pat. No. 6,464,368 Bi includes a socket 91, a light emitting element 911 to be screwed onto the socket, a light mask 92 formed by an upper housing 921 and a lower housing 922; on the upper end of the light mask 92, there is a light decorative tube 93, the sodium sulfide and silicon oxide are filled inside the tube 93 and then heated to 30° C.~35° C.; after it is cooled, a layer of deposition 931 is formed at its bottom; after that, a fixed amount of dichloromethane 90 is put in; finally, the upper end of the tube 93 is opened so as to expel the gases and then the tube 93 is sealed.

When the light emitting element 911 is turned on, heat is emitted together with light from the light emitting element 911 to the deposition 931 inside the light decorative tube 93, and then the dichloromethane 90 becomes a lot of bubbles 900. At the same time, light is reflected in different directions inside the light decorative tube 93. Therefore, such construction has the disadvantages of poor decorations; in addition, since the dichloromethane is poisonous, it is dangerous and easy to cause pollutions.

SUMMARY OF THE INVENTION

Accordingly, it is an object of the present invention to provide a multi-variation decorative lamp, which combines a functions control device for generating and emitting multi-types of electric waves, such that lights of different wavelengths would be emitted via light emitting elements, and then by the materials with identical or different light-absorbing efficiencies to be attached onto or put inside the light-emitting element, a function of multi-variation decoration is then obtained.

According to the multi-variation decorative lamp of present invention, the functions control device generates and emits one type of electric-wave, and lights are emitted through decorative objects made of materials with same reflection coefficient; this is another object of the present invention.

According to the multi-variation decorative lamp of present invention, the functions control device generates and emits one type of electric-wave, and lights are emitted through decorative objects made of materials with different reflection coefficients; this is another object of the present invention.

According to the multi-variation decorative lamp of present invention, the functions control device generates and emits one type of electric-wave, and lights are emitted through decorative objects made of materials with same refraction coefficient; this is another object of the present invention.

According to the multi-variation decorative lamp of present invention, the functions control device generates and emits one type of electric-wave, and lights are emitted through decorative objects made of materials with different refraction coefficients; this is another object of the present invention.

According to the multi-variation decorative lamp of present invention, the functions control device generates and emits one type of electric-wave, and lights are emitted through decorative objects made of materials with same light-absorbing efficiency; this is another object of the present invention.

According to the multi-variation decorative lamp of present invention, the functions control device generates and emits one type of electric-wave, and lights are emitted through decorative objects made of materials with different light-absorbing efficiencies; this is another object of the present invention.

According to the multi-variation decorative lamp of present invention, it can cooperate with one of the reflective materials, or one of the refractive materials, or one of the light-absorbing materials; this is another object of the present invention.

A more complete understanding of these and other features and advantages of the patent invention will become apparent from a careful consideration of the following detailed description of certain embodiments illustrated in the accompanying drawings.

DETAILED DESCRIPTION OF THE PREFERRED EMBODIMENTS

Figure 1:
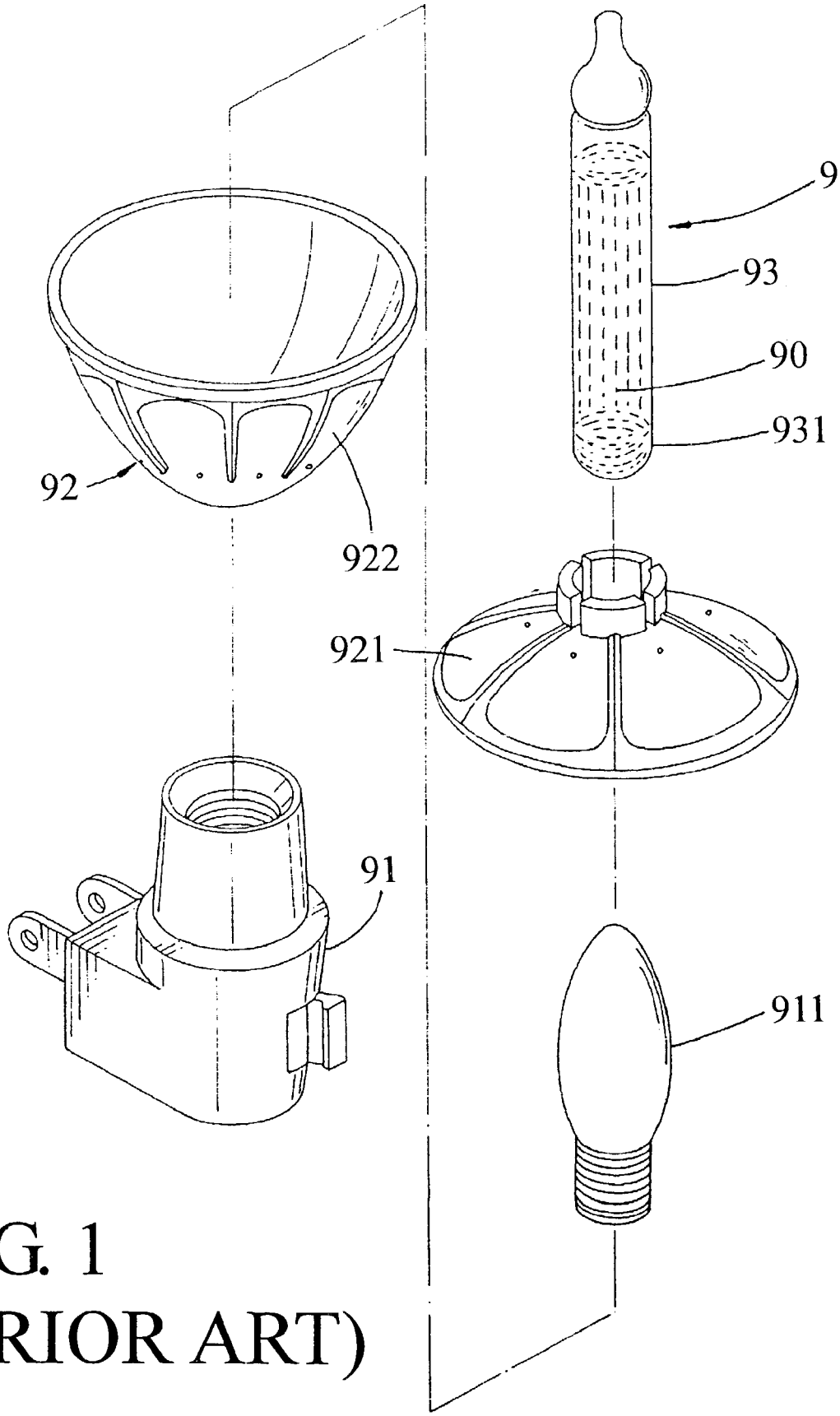
FIG. 1 (PRIOR ART)
FIG. 1 is an exploded perspective view showing the structure of conventional decorative lamp assembly.
Figure 2:
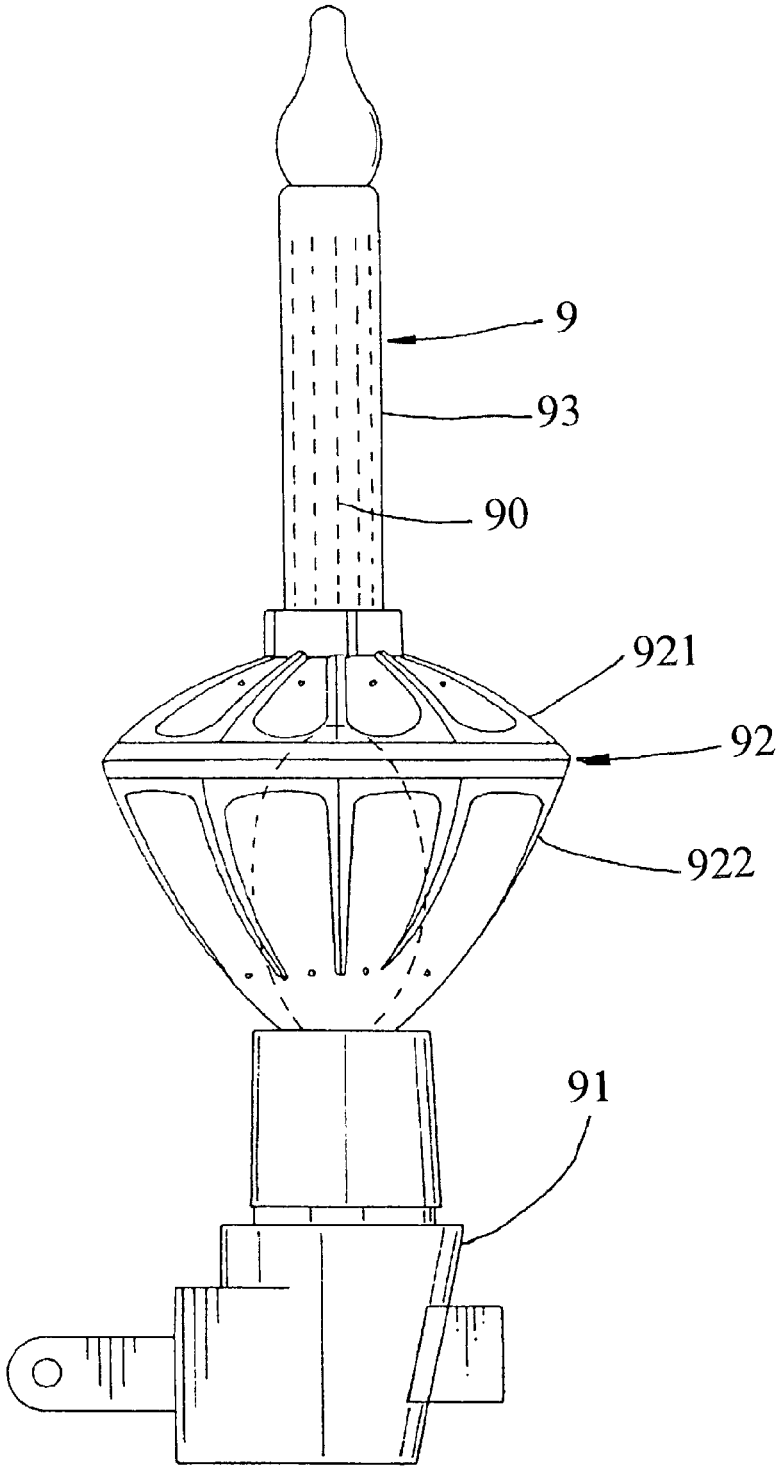
FIG. 2 (PRIOR ART)
FIG. 2 is a plane view of conventional decorative lamp assembly of FIG. 1.
Figure 3:
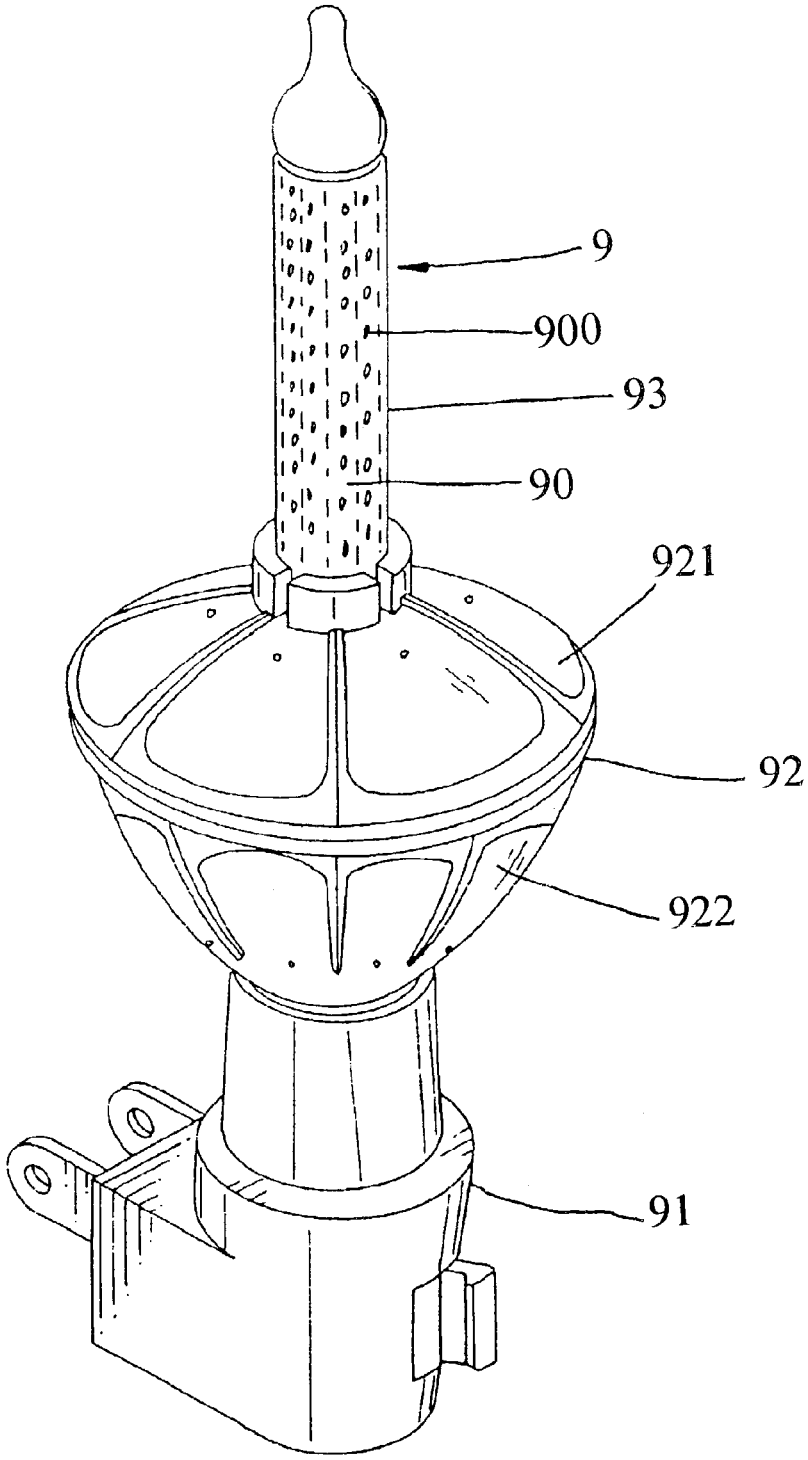
FIG. 3 (PRIOR ART)
FIG. 3 is a perspective view of conventional decorative lamp assembly of FIG. 1.

The construction and disadvantages of a conventional decorative lamp assembly according to FIGS. 1, 2, and 3 are described above. It is not repeated herewith.

Figure 4:
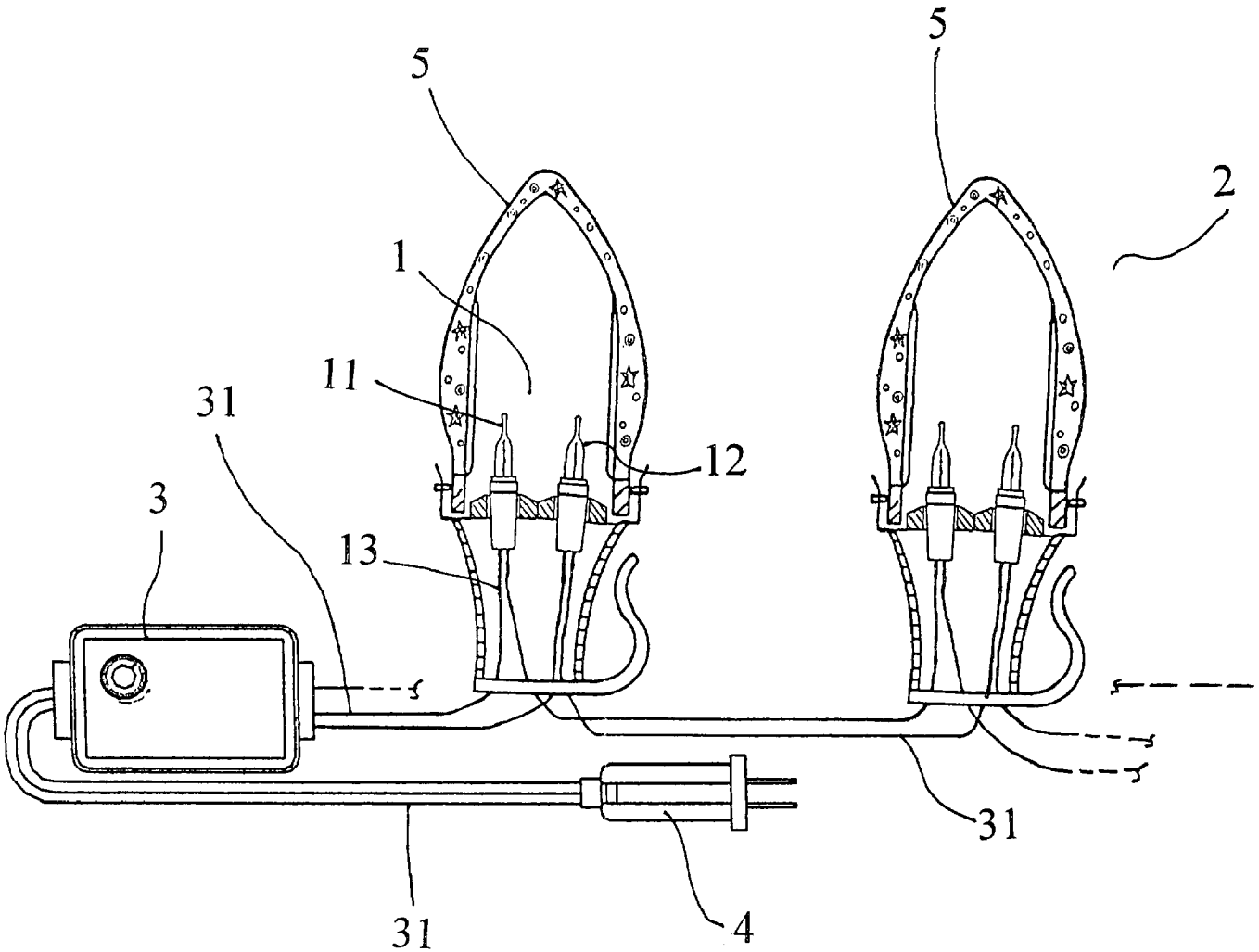
FIG. 4 is a side view showing the construction of the first preferred embodiment of present invention.

As shown in FIG. 4, the multi-variation decorative lamp of present invention includes: at least two light emitting devices 1, 2, each of the light emitting devices comprises respectively at least two light emitting units 11, 12; said light emitting units 11, 12 can be tungsten filament bubbles, they are connected by electric wires 13, such that they are electrically connected to each other; the bubbles of said light emitting units 11, 12 can be coated with colorful materials including light reflective materials or refractive materials or light-absorbing materials, such that each of light emitting units 11, 12 is capable of emitting lights of different wave-lengths;

a functions control device 3, it is connected to said light emitting devices 1, 2 by electric wires 31, and it controls the lighting of said light emitting units 11, 12 inside the light emitting devices 1, 2;

a power supply device 4, it is connected to said functions control device 3 and not only supply electricity to light emitting devices 1, 2, but also control the lightings of light emitting units 11, 12;

decorative objects 5, attached onto the outersurfaces of said light emitting devices 1, 2, the surfaces of said decorative objects are formed by one or a plurality of light penetrating materials with identical or different reflection coefficients, refraction coefficients, and light-absorbing efficiencies. Therefore, it can be a transparent or semi-transparent plastics or glass materials. It also can be the above-mentioned materials with coloring substances, or transparent, or semi-transparent coating layers having interesting outer shapes.

With the construction described above, when the power supply device 4 supplies electric power to said functions control device 3, then the lights controlled by functions control device 3 are emitted by the light emitting units 11, 12, and the lights emitted from the light emitting units 11, 12 display multi-variation decorative functions due to the decorative objects 5, which is attached onto the outer surfaces of said light emitting devices 1, 2, and formed by one or a plurality of light penetrating materials with identical or different reflection coefficients, refraction coefficients, and light-absorbing efficiencies.

Figure 5:
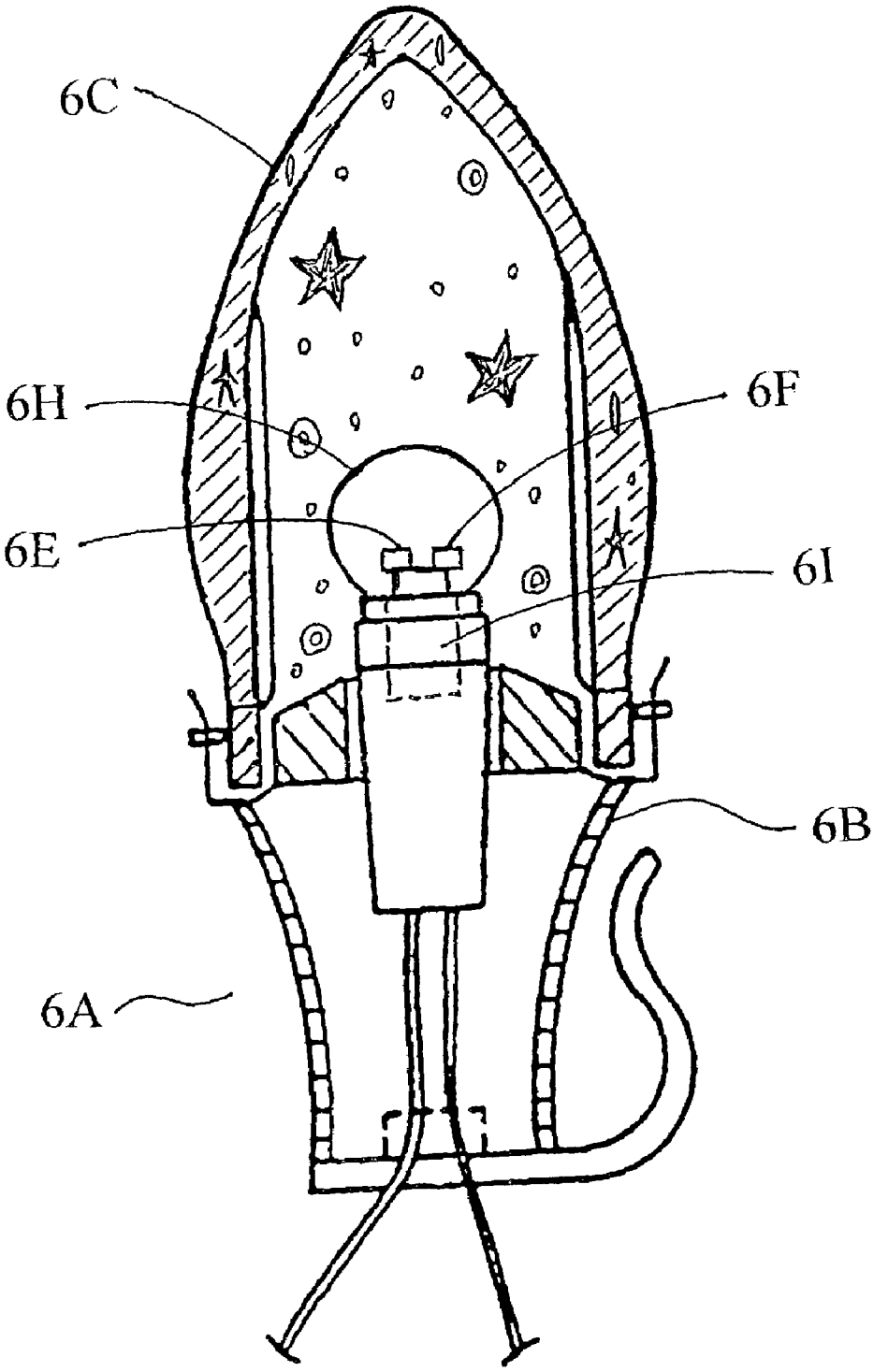
FIG. 5 is a side cross sectional view showing the construction of the second preferred embodiment of the light emitting unit of present invention.

As shown in FIG. 5, the light emitting device 6A of the second preferred embodiment of the present invention has a base seat 6B formed at its lower end for supporting the decorative objects 6C of its upper end. Inside the light emitting device 6A, there is a light emitting unit 6G formed by LED chips (or LED light emitting elements) 6E, 6F; said light emitting chips (or light emitting elements) 6E, 6F can emit lights in combination with different wave-lengths; outside the light emitting unit 6G, there is a housing 6H, and its lower end is connected to functions control device 61, while the surface of said decorative object 5 is covered by a coating layer formed by one or a plurality of light penetrating materials with identical or different reflection coefficients, refraction coefficients and light-absorbing efficiencies. Said coating layer also can be different in shape. And when it is made of a light-penetrating material, it can be formed with many kinds of shapes, patterns, letters, or colors, its alignment also can be formed in many styles and it can be formed in connection with light emitting unit.

Figure 6:
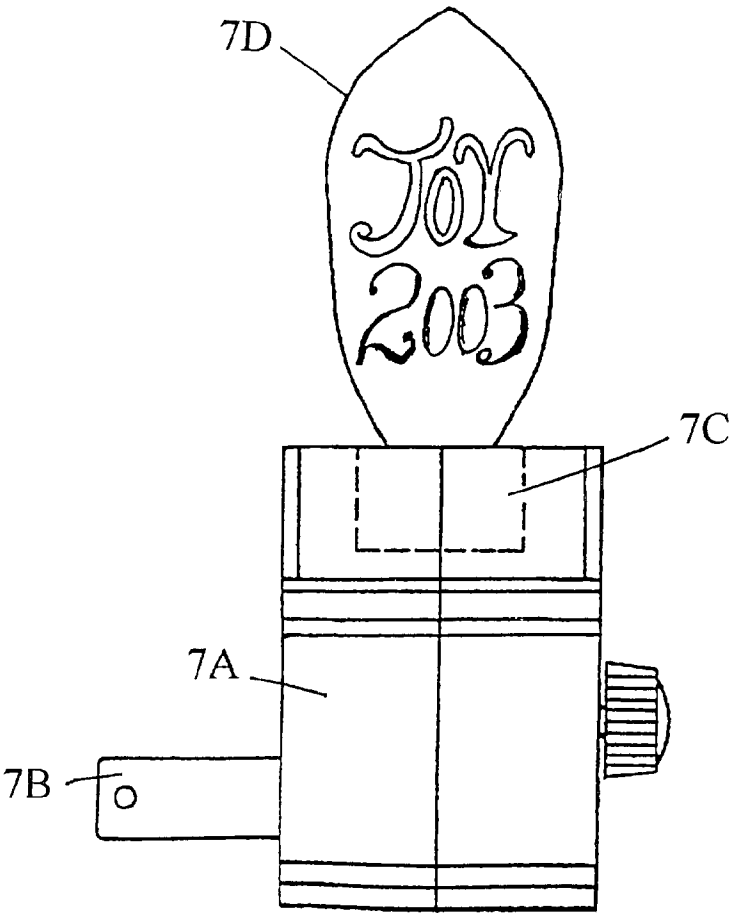
FIG. 6 is a side view showing the construction of the third preferred embodiment of present invention.

As shown in FIG. 6, the third preferred embodiment of the present invention provides a base seat with larger volume, which is a combination of functions control device 7A, power supply device 7B and light emitting unit 7C. The decorative object 7D is equipped at its upper end, while the lower end of said decorative object 7D then connects with light emitting unit. On the surface of said decorative object 7D, English characters or Arabian numerals can be formed.

Figure 7:
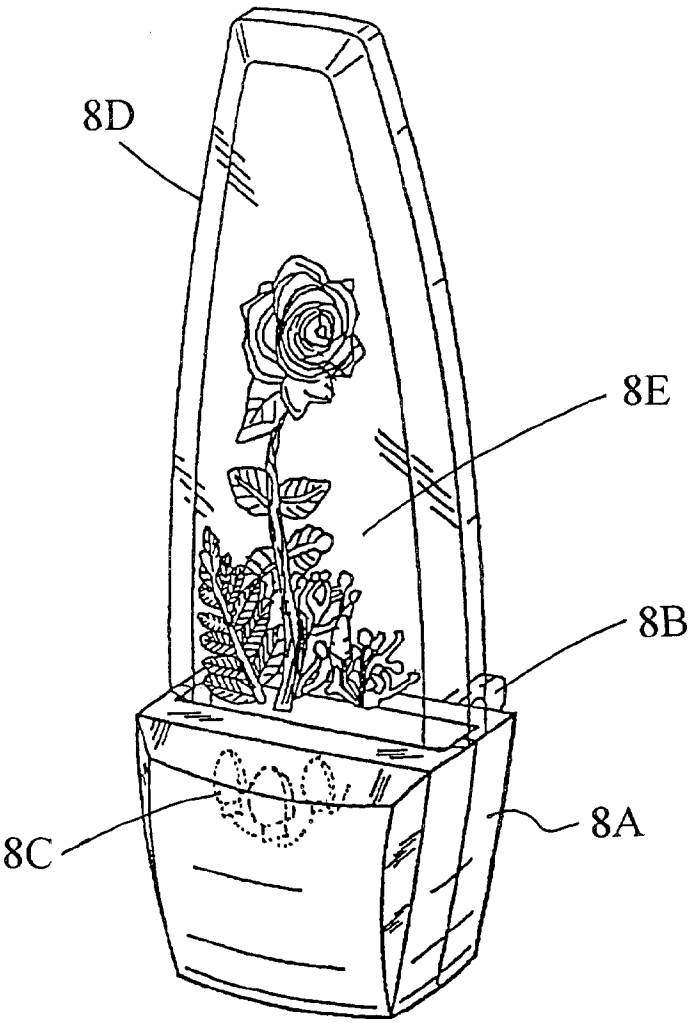
FIG. 7 is a perspective view showing the construction of the fourth preferred embodiment of present invention.

As shown in FIG. 7, the fourth preferred embodiment of the present invention also provides a base seat, which is also a combination of functions control device 8A, power supply device 8B, and light emitting unit 8C. The decorative object 8D with large volume is equipped at its upper end. While the lower end of said decorative object 8D then connects with light emitting unit. On the surface of said decorative object 8D, a design of flowers 8E can be formed.

Figure 8:
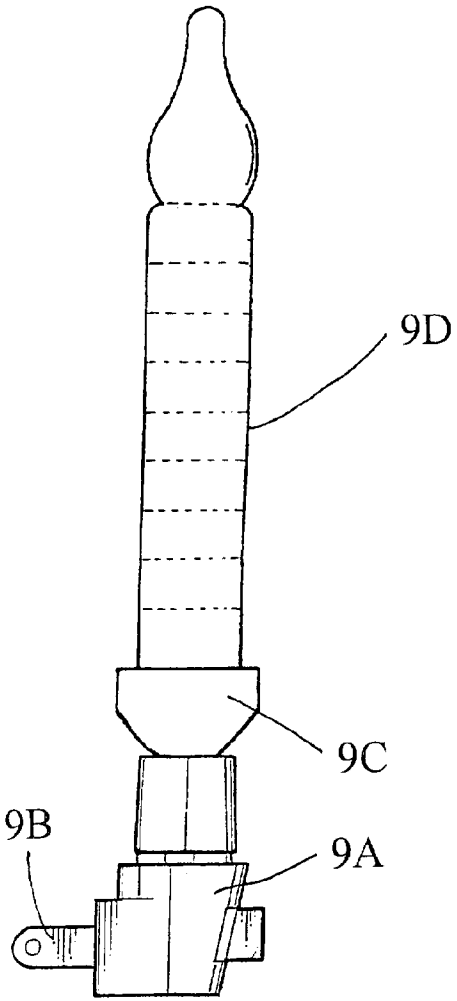
FIG. 8 is a side view showing the construction of the fifth preferred embodiment of present invention.

As shown in FIG. 8, the fifth preferred embodiment of the present invention also provides a base seat, which is also a combination of functions control device 9A, power supply device 9B, and light emitting unit 9C. Said functions control device 9A is equipped with functions of generating and emitting electric waves with adjusted strength, time, and sequence. Furthermore, it is connected to said light emitting unit to control the light emitted from this light emitting unit. The decorative object 9D located above the light emitting unit 9C is formed in a long tube shape, the surface of long-tube light emitting unit 9C is formed in a long tube shape, the surface of long-tube light emitting unit 9C is formed with lines patterned by materials with identical or different reflection coefficients, refraction coefficients and light-absorbing efficiencies. When electric waves are varied according to said functions control device, the light emitted from said light emitting unit 9C would be changed, then the decorative object 9D would generate functions of different dynamic patterns, characters, or colors.

Figure 9:
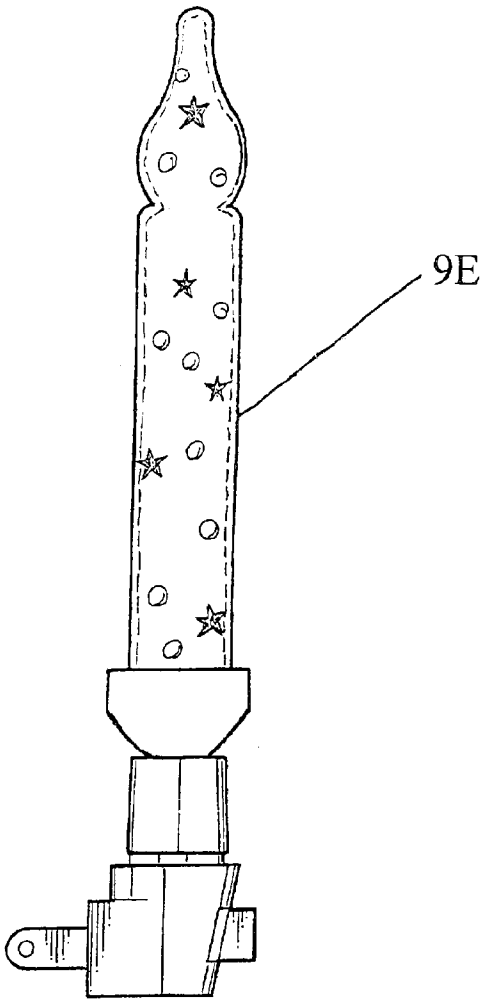
FIG. 9 is a side view showing the construction of the sixth preferred embodiment of present invention.

As shown in FIG. 9, in the sixth preferred embodiment of the present invention, the surface of the long tube shape emitting unit is a decorative object 9E, which is formed with drawings patterned by light penetrating materials with identical or different reflection coefficients, refraction coefficients and light-absorbing efficiencies.

Figure 10:
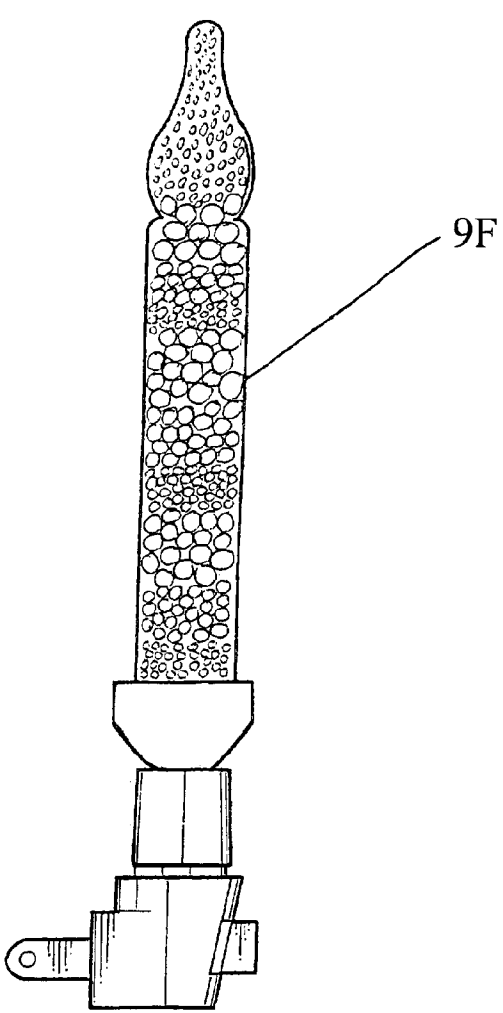
FIG. 10 is a side view showing the construction of the seventh preferred embodiment of present invention.

As shown in FIG. 10, in the seventh preferred embodiment of the present invention, the surface of the long tube shape emitting unit is a decorative object 9F, which is formed with drawings containing a lot of balls in different sizes with identical or different reflection coefficients, refraction coefficients and light-absorbing efficiencies.

Figure 11:
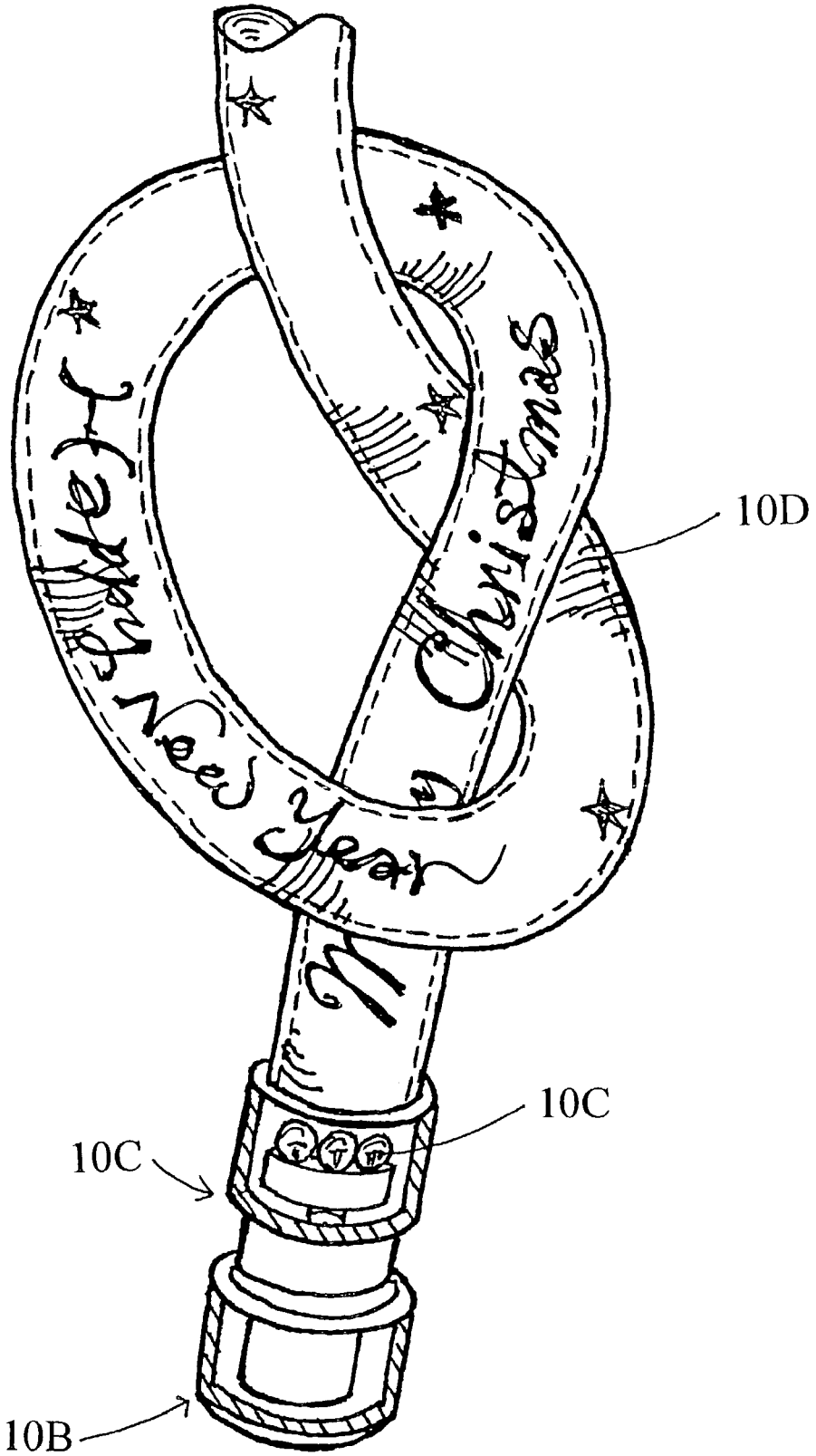
FIG. 11 is a perspective view showing the construction of the eighth preferred embodiment of present invention.

As shown in FIG. 11, in the eighth preferred embodiment of the present invention, the base seat provided by combining functions control device 10A, power supply device 10B, and light emitting unit 10C is a long tube, while the decorative object 10D can also be a long-twisted tube. On the surface of the decorative object 10D, different drawings, English letters, or Arabic numerals etc. can be formed.

Figure 12:
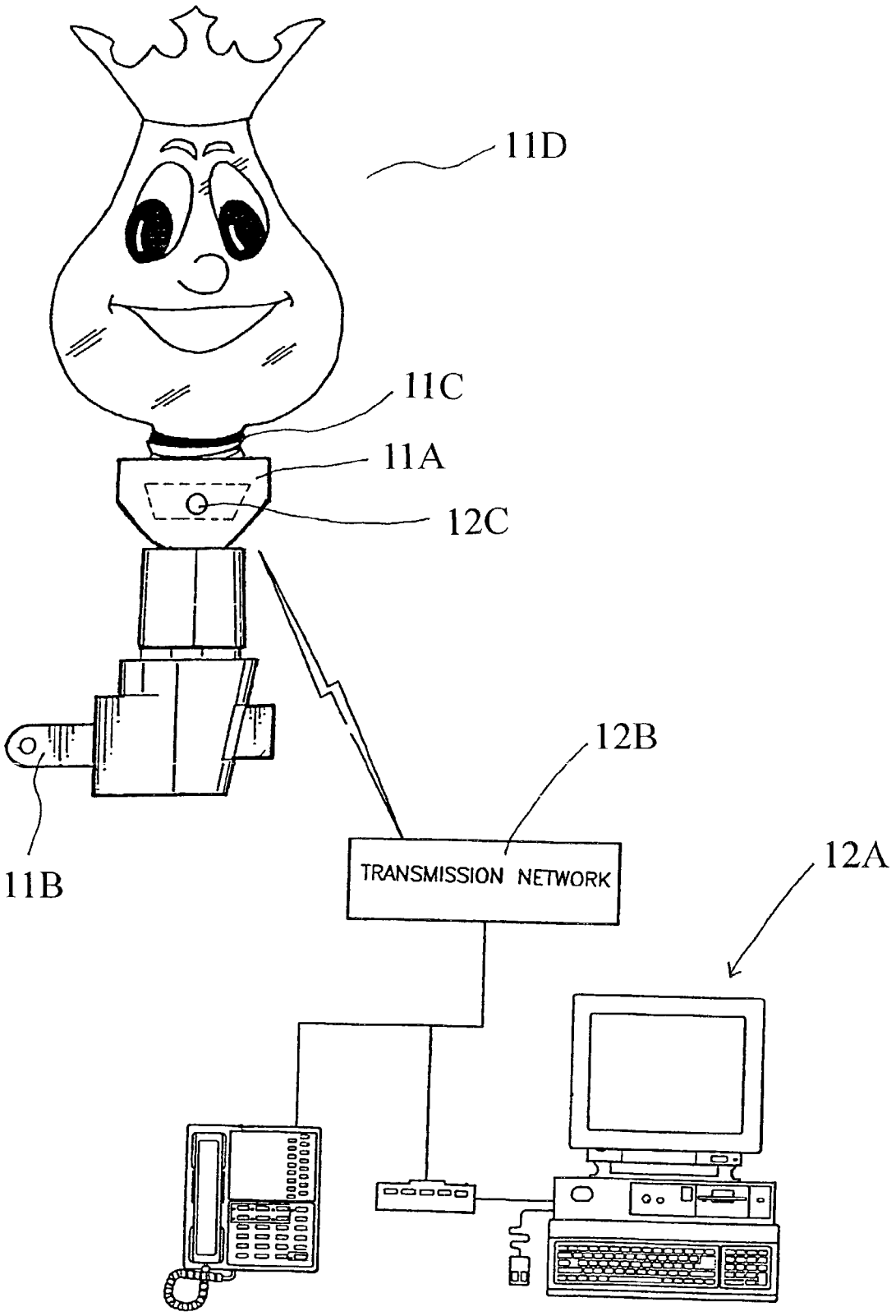
FIG. 12 is a side view showing the construction of the ninth preferred embodiment of present invention in uses.

As shown in FIG. 12, the ninth preferred embodiment of the present invention provides a long-stripped base seat combined by functions control device 10A, power supply device 10B, and light emitting unit 10C. A decorative object 11D with an outline of carton is equipped onto the base seat. The surface of the decorative object 11D is formed with patterns, English letters, or Arabic numerals etc. The lamp can be controlled by wireless transmission, that is, a wireless transmitting equipment includes signal generating device 12A, a transmitter 12B, and a signal receiver 12C. The signal for transmission includes IR or RF signal with many types of electric waves. And, the wireless transmitting equipment includes functions of voltage converting, current filtering, wave forms changing, ON/OFF, timer, and strength adjusting; while the receiver can be included inside said base seat or power supply device.

From the descriptions of above, it is clearly seen that the present invention can actually display light decorative functions of many variations, it still does not have seen in public and complies with conditions of approvable patent.

Although the present invention has been described with a certain degree of particularity, the present disclosure has been made by way of example and changes in details of structure may be made without departing from the spirit thereof.

What is claimed is:

1. A multi-variation decorative lamp comprising:

a first light emitting means radiating light of a first wavelength and a second light emitting means radiating light of a second wavelength concurrently with said first light emitting means, said second wavelength being different from said first wavelength;

a simultaneous multi-functional control device connected to said first light emitting means and to said second light emitting means to simultaneously generate and control said first wavelength and said second wavelength according to a set of pre-designed functions;

a power supply device connected to said simultaneous multi-functional control device to supply power to said first and second light emitting means; and a set of decorative objects formed by a light penetrating material having a identical or different reflection or refraction coefficients or of a light-absorbing efficiency, said decorated objects interposed between a viewing location and said first and second light emitting means to condition the light appearance of said first wavelength and said second wavelength and provide two separately discernable simultaneous light effects at said viewing location.

2. A multi-variation decorative lamp comprising:

a first light emitting element radiating light of a first wavelength and a second light emitting element radiating light of a second wavelength concurrently with said first light emitting element, said second wavelength being different from said first wavelength;

a simultaneous multi-functional control device connected to said first light emitting element and to said second light emitting element to simultaneously generate and control said first wavelength and said second wavelength according to a set of pre-designed functions;

a power supply device connected to said simultaneous multi-functional control device to supply power to said light emitting elements; and a set of decorative objects formed by a light penetrating material having a identical or different reflection or refraction coefficient or of a light-absorbing efficiency, said decorated objects interposed between said light emitting elements and a viewing location according to a set of pre-designed conditions, to condition the light appearance of said first wavelength and said second wavelength and provide two separately discernable simultaneous light patterns, characters, or colors at said viewing location.

3. A multi-variation decorative lamp comprising:

a first light emitting element radiating light of a first wavelength and a second light emitting element radiating light of a second wavelength concurrently with said first light emitting element, said second wavelength being different from said first wavelength;

a simultaneous multi-functional control device connected to said first light emitting element and to said second light emitting element to simultaneously generate and control said first wavelength and said second wavelength according to a set of pro-designed functions of ON/OFF, strength adjusting, timer, in sequence or in random, etc.;

a power supply device connected to said simultaneous multi-functional control device to supply power to said light emitting elements; and a set of decorative objects formed by a light penetrating material having identical or a different reflection or refraction coefficient or of a light-absorbing efficiency, said decorated objects interposed between said light emitting elements and a viewing location according to a set of pre-designed conditions, to condition the light appearance of said first wavelength and said second wavelength and provide two separately discernable simultaneous light patterns, characters, or colors at said viewing location.

4. A multi-variation decorative lamp according to claim 1, wherein the light emitting means is a tungsten bubble.

5. A multi-variation decorative lamp according to claim 2, wherein the light emitting element is a tungsten bubble.

6. A multi-variation decorative lamp according to claim 3, wherein the light emitting element is a tungsten bubble.

7. A multi-variation decorative lamp according to claim 1, wherein said decorative objects are colorful materials coated onto the surface of a bubble, so as to reflect, refract or absorb light of different wave lengths in combination.

8. A multi-variation decorative lamp according to claim 2, wherein said decorative objects are colorful materials coated onto the surface of a bubble, so as to reflect, refract or absorb light of different wave lengths in combination.

9. A multi-variation decorative lamp according to claim 3, wherein said decorative objects are colorful materials coated onto the surface of a bubble, so as to reflect, refract or absorb light of different wave lengths in combination.

10. A multi-variation decorative lamp according to claim 1, wherein said light-emitting means are encased in an LED.

11. A multi-variation decorative lamp according to claim 2, wherein said light-emitting elements are encased in an LED.

12. A multi-variation decorative lamp according to claim 3, wherein said light-emitting elements are encased in an LED.

13. A multi-variation decorative lamp according to claim 10, wherein said light emitting means are chips radiating light of different wavelengths from each other simultaneously.

14. A multi-variation decorative lamp according to claim 11, wherein said light emitting elements are chips radiating light of different wavelengths from each other simultaneously.

15. A multi-variation decorative lamp according to claim 12, wherein said light emitting elements are chips radiating light of different wavelengths from each other simultaneously.

16. A multi-variation decorative lamp according to claim 1, wherein said light-emitting means are protected and connected by insulators.

17. A multi-variation decorative lamp according to claim 2, wherein said light-emitting elements are protected and connected by insulators.

18. A multi-variation decorative lamp according to claim 3, wherein said light-emitting elements are protected and connected by insulators.

19. A multi-variation decorative lamp according to claim 1, wherein said light-emitting means are separated or combined to form an entity.

20. A multi-variation decorative lamp according to claim 2, wherein said light-emitting elements are separated or combined to form an entity.

21. A multi-variation decorative lamp according to claim 3, wherein said light-emitting elements are separated or combined to an entity.

22. A multi-variation decorative lamp according to claim 1, wherein said functional control device is combined by IC and many electronic elements.

23. A multi-variation decorative lamp according to claim 2, wherein said functional control device is combined by IC and many electronic elements.

24. A multi-variation decorative lamp according to claim 3, wherein said functional control device is combined by IC and many electronic, elements.

25. A multi-variation decorative lamp according to claim 1, wherein said functional control device controls the functions of ON/OFF, voltage converting, current rectifying, wave forms converting, timing, and wave strength adjustment.

26. A multi-variation decorative lamp according to claim 2, wherein said functional control device controls the functions of ON/OFF, voltage convening, current rectifying, wave forms convening, timing, and wave strength adjustment.

27. A multi-variation decorative lamp according to claim 3, wherein said functional control device controls the functions of ON/OFF, voltage converting, current rectifying, wave forms converting, timing, and wave strength adjustment.

28. A multi-variation decorative lamp according to claim 1, wherein said functional control device, said light emitting means, and said power supply device are connected by electric wires.

29. A multi-variation decorative lamp according to claim 2, wherein said functional control device, said light emitting elements, and said power supply device are connected by electric wires.

30. A multi-variation decorative lamp according to claim 3, wherein said functional control device, said light emitting elements, and said power supply device are connected by electric wires.

31. A multi-variation decorative lamp according to claim 1, wherein said functional control device, said light emitting means and said power supply device are connected by a wireless transmitting apparatus.

32. A multi-variation decorative lamp according to claim 2, wherein said functional control device, said light emitting elements and said power supply device are connected by a wireless transmitting apparatus.

33. A multi-variation decorative lamp according to claim 3, wherein said functional control device, said light emitting elements and said power supply device are connected by a wireless transmitting apparatus.

34. A multi-variation decorative lamp according to claim 31, wherein said wireless transmitting apparatus includes a signal generator, a signal transmitter, and a signal receiver fix transmitting signal.

35. A multi-variation decorative lamp according to claim 32, wherein said wireless transmitting apparatus includes a signal generator, a signal transmitter, and a signal receiver for transmitting signal.

36. A multi-variation decorative lamp according to claim 33, wherein said wireless transmitting apparatus includes a signal generator, a signal transmitter, and a signal receiver far transmitting signal.

37. A multi-variation decorative lamp according to claim 34, wherein said transmitting signal is IR or RF.

38. A multi-variation decorative lamp according to claim 35, wherein said transmitting signal is IR or RF.

39. A multi-variation decorative lamp according to claim 36, wherein said transmitting signal is IR or RF.

40. A multi-variation decorative lamp according to claim 1, wherein said functional control device and said light emitting means are encased inside a unitary body.

41. A multi-variation decorative lamp according to claim 2, wherein said functional control device and said light emitting elements are encased inside a unitary body.

42. A multi-variation decorative lamp according to claim 3, wherein said functional control device and said light emitting elements are encased inside a unitary body.

43. A multi-variation decorative lamp according to claim 1, wherein said decorative objects are made of transparent or semi-transparent materials such as plastics, glasses, etc.

44. A multi-variation decorative lamp according to claim 2, wherein said decorative objects are made of transparent or semi-transparent materials such as plastics, glasses, etc.

45. A multi-variation decorative lamp according to claim 3, wherein said decorative objects are made of transparent or semi-transparent materials such as plastics, glasses, etc.

46. A multi-variation decorative lamp according to claim 43, wherein colors are coated on said transparent or semi-transparent materials.

47. A multi-variation decorative lamp according to claim 44, wherein colors are coated on said transparent or semi-transparent materials.

48. A multi-variation decorative lamp according to claim 45, wherein colors are coated on said transparent or semi-transparent materials.

49. A multi-variation decorative lamp according to claim 1, wherein said decorative objects are formed by transparent or semi-transparent materials with pre-designed shapes.

50. A multi-variation decorative lamp according to claim 2, wherein said decorative objects are formed by transparent or semi-transparent materials with pre-designed shapes.

51. A multi-variation decorative lamp according to claim 3, wherein said decorative objects are formed by transparent or semi-transparent materials with pre-designed shapes.

52. A multi-variation decorative lamp according to claim 1, wherein said light-penetrating materials of said decorative objects have different or identical shapes, patterns, characters, and colors, and have special alignments.

53. A multi-variation decorative lamp according to claim 2, wherein said light-penetrating materials of said decorative objects have different or identical shapes, patterns, characters, and colors, and have special alignments.

54. A multi-variation decorative lamp according to claim 3, wherein said light-penetrating materials of said decorative objects have different or identical shapes, patterns, characters, and colors, and have special alignments.

55. A multi-variation decorative lamp according to claim 1, wherein said decorative objects are connected with said light-emitting means or said light-emitting means are included inside said decorative objects.

56. A multi-variation decorative lamp according to claim 2, wherein said decorative objects are connected with said light-emitting elements or said light-emitting elements are included inside said decorative objects.

57. A multi-variation decorative lamp according to claim 3, wherein said decorative objects are connected with said light-emitting elements or said light-emitting elements are included inside said decorative objects.

* * * * *